US007730635B2

(12) United States Patent
Aveni et al.

(10) Patent No.: US 7,730,635 B2
(45) Date of Patent: Jun. 8, 2010

(54) IMPACT-ATTENUATION MEMBERS AND PRODUCTS CONTAINING SUCH MEMBERS

(75) Inventors: Michael A. Aveni, Lake Oswego, OR (US); Patricia L. Smaldone, Portland, OR (US); Fred G. Fagergren, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 919 days.

(21) Appl. No.: 11/422,138

(22) Filed: Jun. 5, 2006

(65) Prior Publication Data

US 2007/0119074 A1 May 31, 2007

Related U.S. Application Data

(63) Continuation-in-part of application No. 10/949,812, filed on Sep. 27, 2004, now Pat. No. 7,314,125.

(51) Int. Cl.
*A43B 13/18* (2006.01)
*A43B 13/20* (2006.01)

(52) U.S. Cl. ..... 36/27; 36/28; 36/35 R; 36/37

(58) Field of Classification Search ..... 36/27, 36/28, 37, 35 R
See application file for complete search history.

(56) References Cited

U.S. PATENT DOCUMENTS

| | | | | |
|---|---|---|---|---|
| 1,942,312 | A | | 1/1934 | Tutoky |
| 2,437,227 | A | | 3/1948 | Hall |
| 3,204,913 | A | | 9/1965 | Lawrence et al. |
| 4,342,158 | A | | 8/1982 | McMahon et al. |
| 4,492,374 | A | | 1/1985 | Lekhtman et al. |
| 4,535,553 | A | | 8/1985 | Derderian et al. |
| 4,536,974 | A | | 8/1985 | Cohen |
| 4,566,678 | A | | 1/1986 | Anderson |
| 4,592,153 | A | * | 6/1986 | Jacinto ..... 36/38 |
| 4,611,412 | A | | 9/1986 | Cohen |
| 4,753,021 | A | | 6/1988 | Cohen |

(Continued)

FOREIGN PATENT DOCUMENTS

CA 2 279 604 A1 2/2001

(Continued)

OTHER PUBLICATIONS

International Search Report and Written Opinion in corresponding PCT Application, International Application No. PCT/US2005/033920, mailed Jun. 1, 2006.

(Continued)

*Primary Examiner*—Marie Patterson
(74) *Attorney, Agent, or Firm*—Banner & Witcoff, Ltd.

(57) ABSTRACT

Impact-attenuation members include body portions, optionally with an arched structure, that define a base orientation and an open space; and a spring member extending across the open space and engaging the body portion(s). When a force is applied to the body portion(s) in at least some orientations and/or directions of incident force, e.g., so as to change the impact-attenuation member out of its base orientation, the spring member may exert a force that urges the impact-attenuation member back toward the base orientation. Various example structures for the impact-attenuation member are described. Such impact-attenuation members may be used in articles of footwear or other foot-receiving device products.

37 Claims, 10 Drawing Sheets

U.S. PATENT DOCUMENTS

| | | | | |
|---|---|---|---|---|
| 4,774,774 | A | 10/1988 | Allen, Jr. | |
| 4,815,221 | A | 3/1989 | Diaz | |
| 4,843,737 | A * | 7/1989 | Vorderer | 36/38 |
| 4,901,987 | A | 2/1990 | Greenhill et al. | |
| 4,914,836 | A * | 4/1990 | Horovitz | 36/28 |
| 5,138,776 | A * | 8/1992 | Levin | 36/38 |
| 5,205,798 | A | 4/1993 | Lekhtman | |
| 5,224,277 | A | 7/1993 | Sang Do | |
| 5,224,280 | A * | 7/1993 | Preman et al. | 36/30 R |
| 5,280,890 | A | 1/1994 | Wydra | |
| 5,353,526 | A | 10/1994 | Foley et al. | |
| 5,409,200 | A | 4/1995 | Zingher et al. | |
| 5,461,800 | A | 10/1995 | Luthi et al. | |
| D376,471 | S | 12/1996 | Kalin et al. | |
| 5,588,165 | A | 12/1996 | Fromme | |
| 5,643,148 | A | 7/1997 | Naville | |
| 5,701,685 | A | 12/1997 | Pezza | |
| 5,743,028 | A | 4/1998 | Lombardino | |
| 5,822,886 | A | 10/1998 | Luthi et al. | |
| 5,871,298 | A | 2/1999 | Lekhtman et al. | |
| 5,916,071 | A | 6/1999 | Lee | |
| 6,006,449 | A * | 12/1999 | Orlowski et al. | 36/27 |
| 6,266,897 | B1 | 7/2001 | Seydel et al. | |
| 6,282,814 | B1 | 9/2001 | Krafsur et al. | |
| D450,437 | S | 11/2001 | Simpson et al. | |
| 6,318,001 | B1 | 11/2001 | Lee | |
| 6,374,514 | B1 * | 4/2002 | Swigart | 36/35 B |
| 6,401,887 | B1 | 6/2002 | Hur | |
| 6,457,261 | B1 | 10/2002 | Crary | |
| 6,516,540 | B2 | 2/2003 | Seydel et al. | |
| 6,530,564 | B1 | 3/2003 | Julien | |
| 6,533,258 | B2 | 3/2003 | Monson et al. | |
| 6,546,648 | B2 * | 4/2003 | Dixon | 36/25 R |
| 6,665,957 | B2 | 12/2003 | Levert et al. | |
| 6,669,184 | B2 | 12/2003 | Cai et al. | |
| 6,684,531 | B2 | 2/2004 | Rennex | |
| 6,722,670 | B1 | 4/2004 | Lee | |
| 6,807,753 | B2 | 10/2004 | Steszyn et al. | |
| 6,886,274 | B2 | 5/2005 | Krafsur et al. | |
| 6,994,333 | B2 | 2/2006 | Lobry et al. | |
| 7,314,125 | B2 | 1/2008 | Smaldone et al. | |
| 7,458,172 | B2 | 12/2008 | Aveni | |
| 2002/0163114 | A1 | 11/2002 | Lobry et al. | |
| 2003/0110661 | A1 * | 6/2003 | Wu | 36/27 |
| 2003/0192200 | A1 * | 10/2003 | Dixon | 36/27 |
| 2004/0049946 | A1 | 3/2004 | Lucas et al. | |
| 2004/0128860 | A1 | 7/2004 | Smaldone et al. | |
| 2004/0154191 | A1 | 8/2004 | Park | |
| 2005/0028403 | A1 * | 2/2005 | Swigart et al. | 36/28 |
| 2005/0102857 | A1 * | 5/2005 | Yen | 36/28 |
| 2006/0064900 | A1 | 3/2006 | Aveni | |
| 2006/0065499 | A1 | 3/2006 | Smaldone | |
| 2006/0112592 | A1 * | 6/2006 | Leedy et al. | 36/29 |
| 2007/0033830 | A1 * | 2/2007 | Chang | 36/28 |
| 2007/0113425 | A1 * | 5/2007 | Wakley et al. | 36/28 |
| 2007/0193065 | A1 * | 8/2007 | Nishiwaki et al. | 36/27 |
| 2007/0277395 | A1 * | 12/2007 | Aveni et al. | 36/27 |

FOREIGN PATENT DOCUMENTS

| | | |
|---|---|---|
| CN | 1159148 | 9/1997 |
| DE | 3048787 A1 | 7/1982 |
| DE | 20000403 | 5/2001 |
| EP | 1530913 | 5/2005 |
| JP | 3-195503 | 7/2006 |
| WO | 95/20333 | 1/1995 |
| WO | 96/09778 | 4/1996 |
| WO | 2006/036608 | 4/2006 |
| WO | 2006/036721 | 4/2006 |
| WO | 2007/145809 | 12/2007 |

OTHER PUBLICATIONS

Written Opinion corresponding to PCT/US2005/033275, mailed Apr. 5, 2007.

International Preliminary Report on Patentability corresponding to PCT/US2005/033275, dated Mar. 27, 2007.

Written Opinion corresponding to PCT/US2007/012665.

International Search Report in corresponding PCT Application, International Application Number PCT/US2007012665, mailed Nov. 21, 2008.

International Preliminary Report on Patentability, mailed Dec. 31, 2008.

International Preliminary Report on Patentability in corresponding PCT Application, International Application No. PCT/US2007/012665, mailed Dec. 31, 2008.

Internet Printout: http://niketown.nike.com, Nike Shox Turbo, dated May 11, 2004.

International Search Report dated Dec. 16, 2005.

* cited by examiner

IMPACT-ATTENUATION MEMBERS AND PRODUCTS CONTAINING SUCH MEMBERS

RELATED APPLICATION DATA

This application is a continuation-in-part of U.S. patent application Ser. No. 10/949,812 filed Sep. 27, 2004, now U.S. Pat. No. 7,314,125 entitled "Impact Attenuating and Spring Elements and Products Containing Such Elements," naming Patricia Smaldone, Michael Aveni, and Fred Fagergren as inventors. This priority application is entirely incorporated herein by reference. Additionally, the subject matter of this application generally relates to that described in U.S. patent application Ser. No. 10/949,813, entitled "Impact Attenuating Devices and Products Containing Such Devices," naming Michael Aveni as an inventor. This application also is entirely incorporated herein by reference.

FIELD OF THE INVENTION

The invention relates generally to impact-attenuation members. Such members may be provided in a wide variety of different products, e.g., in footwear products and other foot-receiving devices, such as in the heel, toe, and/or other areas of footwear or foot-receiving device products.

BACKGROUND

Conventional articles of athletic footwear have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground or other contact surface reaction forces, the sole structure may provide traction and control foot motions, such as pronation. Accordingly, the upper member and sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces.

SUMMARY

Aspects of this invention relate to impact-attenuation members and products in which they are used (such as footwear, other foot-receiving devices, and the like). In at least some examples, impact-attenuation members in accordance with at least some example aspects of this invention may include: (a) a first body portion; (b) a second body portion, wherein the first and second body portions, at least in part, define a base orientation of the device and wherein an open space is defined between the first and second body portions; and (c) a first spring member extending across the open space and engaging the first body portion and the second body portion. In such members, at least in some orientations, when a force is applied to the first and/or second body portions so as to change the impact-attenuation member out of its base orientation, the first spring member, which may include a polymeric material element that stretches under the force applied to the body portions, may exert a force that urges the impact-attenuation member to or toward the base orientation. If desired, the impact-attenuation member further may include or attach to one or more base members, e.g., for forming a heel cage or heel unit for mounting in an article of footwear or other foot-receiving device product, for attaching to a footwear or other foot-receiving device product, etc.

In another example structure, an impact-attenuation member in accordance with at least some examples of this invention may include: (a) a first arched body portion; (b) a second arched body portion facing the first arched body portion, wherein an open space is defined between the first and second arched body portions; and (c) a first spring member at least partially included in the open space and extending to at least partially contain (and optionally, to substantially contain) at least one of the first arched body portion and the second arched body portion. In such structures, in at least some orientations, when a force is applied to the first and/or second arched body portions so as to deform at least one of the arched body portions, the first spring member may exert a force (e.g., on the body portions) that urges the impact-attenuation member back to or toward its original or base orientation. If desired, the first spring member may additionally contain one or more additional sections, including, for example, a third arched body portion and a fourth arched body portion facing the third arched body portion, wherein a second open space is defined between the third and fourth arched body portions. The same or a different spring member may extend across this second open space.

Still other aspects of this invention relate to foot-receiving device products, such as articles of footwear (including athletic footwear), that include impact-attenuation members, e.g., of the types described above. Additional aspects of this invention relate to methods of making footwear products including impact-attenuation members in accordance with examples of this invention, as well as to methods of using such impact-attenuation members, e.g., for attenuating contact surface reaction forces. Such methods may include constructing an article of footwear or other foot-receiving device product to include one or more impact-attenuation members according to the invention. Once incorporated in the footwear or other product structure, the article of footwear or other product may be used in its known and conventional manner, and the impact-attenuation member will attenuate the ground reaction forces (e.g., from landing a step or jump). Additionally, impact-attenuation members in accordance with at least some examples of this invention also may resist shear or lateral forces, movement or collapse of the impact-attenuation member (e.g., during direction changes, cutting actions, and the like), etc.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1A:
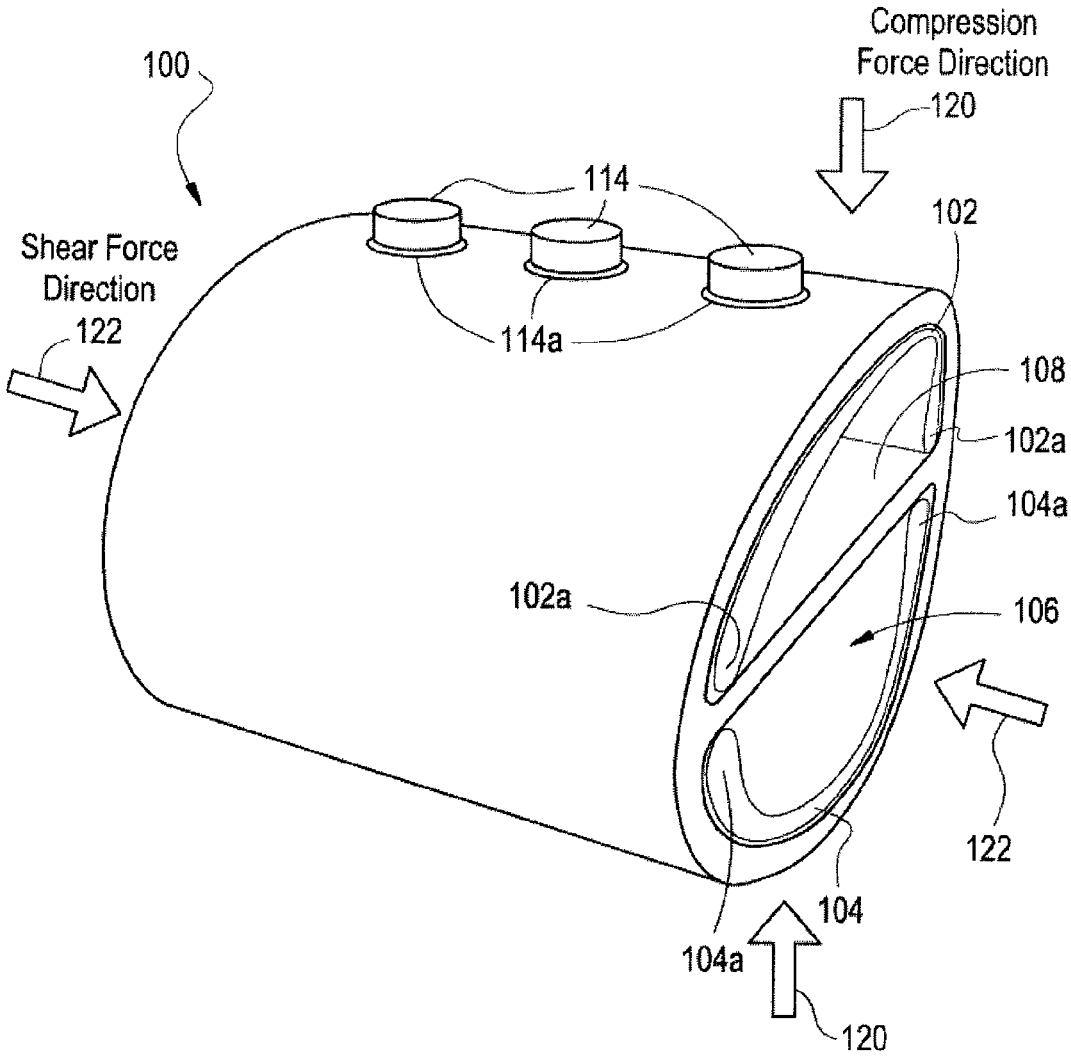
FIGS. 1A through 1C illustrate example impact-attenuation member structures in accordance with this invention.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "side," "front," "rear," "upper," "lower," "vertical," "horizontal," and the like may be used in this specification to describe various example features and elements of the invention, these terms are used herein as a matter of convenience, e.g., based on the example orientations shown in the figures, orientations at rest, and/or orientations during typical use. Nothing in this specification should be construed as requiring a specific three dimensional orientation of structures in order to fall within the scope of this invention.

To assist the reader, this specification is broken into various subsections, as follows: Terms; General Background Relating to the Invention; General Description of Impact-Attenuation Members and Products Containing Them; Specific Examples of the Invention; and Conclusion.

A. TERMS

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, basketball shoes, tennis shoes, baseball cleats, soccer or football cleats, ski boots, etc.), and the like.

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. GENERAL BACKGROUND RELATING TO THE INVENTION

During many typical athletic activities, such as basketball, cross-training, tennis, soccer, baseball, and the like, athletes will need to quickly start, stop, move, and/or change directions (also commonly referred to as "cutting actions" or making "cuts"). During such activities, the lateral or shear force applied to the bottom unit of a shoe can be many times the athlete's body weight. This force, in at least some instances, can cause the impact-attenuating elements of the shoe (e.g., the midsole foam materials, the impact-attenuating column structures, etc.) to buckle, slide, bend over sideways, and/or otherwise partially continue movement in the direction of the force, which can result in "roll-over" (e.g., it can result in the bottom of the outsole member remaining in contact with the ground while the impact-attenuating material (or at least a portion thereof) continues moving, sliding, or rolling over under the applied lateral force) or impact-attenuating column collapse.

Aspects of this invention relate to impact-attenuation members, such as columns and cylinders for the heel, toe, and/or other areas of articles of footwear and other foot-receiving devices, that can provide increased stability against lateral or shear forces. The term "stable against shear forces," as used herein, means that the impact-attenuation member provides resistance against "roll-over" or column collapse, e.g., when the article of footwear (or other device) is used in its intended manner, e.g., for athletic activities, by users of average or typical size and weight. In some more specific examples, the inclusion of the shear resistant member with impact-attenuation members in accordance with this invention (including, for example, the shear resistant member's structure, arrangement, orientation, etc.) will prevent impact-attenuation member roll-over or collapse against shear forces having a magnitude at least 10% greater than the shear forces that would cause roll-over or collapse of a similar impact-attenuation member without the shear resistant member (in other words, the presence of the shear resistant member allows the overall impact-attenuation member structure to withstand at least a 10% greater shear force without roll-over or collapse). In still other examples, the presence of the shear resistant member will allow the overall impact-attenuation member structure to withstand at least a 25% greater shear force, or even a 50%, 75%, 100%, 150%, or 200% greater shear force, without roll-over or collapse, as compared to a similar impact-attenuation member without the shear resistant member.

C. GENERAL DESCRIPTION OF IMPACT-ATTENUATION MEMBERS AND PRODUCTS CONTAINING THEM

In general, aspects of this invention relate to impact-attenuation members, products and systems in which they are used (such as footwear, other foot-receiving devices, heel cage elements, and the like), and methods for including them in such products and systems and methods of using them in such products and systems. These and other aspects and features of the invention are described in more detail below.

1. Impact-Attenuation Members

Impact-attenuation members in accordance with at least some example aspects of this invention include: (a) a first body portion; (b) a second body portion, wherein the first body portion and the second body portion, at least in part, define a base orientation of the device and wherein an open space is defined between the first body portion and the second body portion; and (c) a first spring member extending across the open space and engaging the first body portion and/or the second body portion. In such members, in at least some orientations, when a force is applied to the first body portion and/or the second body portion so as to change the impact-attenuation member out of the base orientation, the first spring member (which may include a polymeric material element that stretches under the force applied to the body portion(s)) may exert a force that urges the impact-attenuation member back to or toward the base orientation.

The impact-attenuation member may come in a wide variety of different physical structures without departing from the invention. For example, the first body portion may include rounded edges or ends that provide movable engagement with the first spring member, and likewise, the second body portion may include similar rounded edges or ends that also provide movable engagement with the first spring member (e.g., on the opposite side of the spring member from the first body portion). If desired, the body portions also may be at least partially contained within the first spring member (e.g., within a chamber defined by the first spring member). Any, some, or all of the first spring member, the first body portion, and/or the second body portion may engage an external structure, such as a base plate, a housing member, a portion of an article of footwear structure, a portion of a foot-receiving device structure, etc., optionally in a releasable or removable manner (e.g., so as to allow exchange of one impact-attenuation member or a portion thereof for another, to allow re-orientation of the impact-attenuation member or a portion thereof, etc.). The overall impact-attenuation member may be symmetrical or asymmetrical (e.g., due to differences between the body portions, their relative sizes, arrangements, or orientations, etc.), without departing from the invention.

The body portions of the impact-attenuation member may be made of any desired number of parts, pieces, or sections without departing from the invention. In some examples, the first body portion may constitute a separate and independent part from the second body portion, optionally arranged to face one another to provide the open space through which the spring member extends. As another example, the first body portion and the second body portion may be joined together or even formed as a unitary, one-piece, overall body construction. The various body portions may be identical to one another, mirror images of one another, or different from one another (e.g., different sizes, shapes, dimensions, orientations within the overall impact-attenuation member, etc.), without departing from this invention. The individual body portions also may be symmetrical or asymmetrical without departing from this invention.

In accordance with at least some examples of the invention, the body portion(s) may define one or more spring engagement portions around the open space to enable mounting of and engagement with the spring member. A wide variety of spring engagement portion structures also are possible without departing from the invention. For example, the spring engagement portions may define a chamber in or on the body portion wall into which an enlarged free end of the spring member fits. Of course, any desired number of spring engagement portions, spring arms, free ends, and the like, in any desired arrangement or orientation, may be used without departing from this invention. Also, if desired, the spring member ends may be removably or releasably engaged with the spring engagement portions, e.g., to allow re-orientation of the spring member, interchange of spring members, etc.

A wide variety of spring member shapes and constructions also are possible without departing from this invention. In accordance with some examples of this invention, the spring member may include a hub or axial member extending in the open space (e.g., between the body portions) with one or more spring member arms extending from the hub or axial member to at least one of the first body portion or the second body portion. Any desired number of arms and any arrangement of the arms are possible without departing from this invention. For example, in some spring member structures, the axial member will include a first end and a second end, and a first spring member arm may extend from the axial member at a position closer to the first end than a position from which a second spring member arm extends from the axial member. As another example, one or more spring member arms may extend from the axial member at substantially a common position along the axial length of the spring member. Some axial members may include three or more spring member arms and/or sets of spring member arms, e.g., evenly spaced, arranged in opposing pairs, arranged along the axial length, and/or arranged in other manners.

In another example structure, an impact-attenuation member in accordance with at least some examples of this invention may include: (a) a first arched body portion; (b) a second arched body portion facing the first arched body portion, wherein an open space is defined between the first arched body portion and the second arched body portion; and (c) a first spring member at least partially included in the open space and extending to at least partially, and in some instances substantially, contain the first arched body portion and the second arched body portion. In such structures, in at least some arrangements or orientations, when a force is applied to the first arched body portion and/or the second arched body portion so as to deform at least one of the arched body portions, the first spring member may exert a force (e.g., on the body portions) that urges the impact-attenuation member back to or toward its original orientation. If desired, the first spring member additionally may contain one or more additional impact-attenuating sections, including, for example, a third arched body portion and a fourth arched body portion facing the third arched body portion, wherein a second open space is defined between the third arched body portion and the fourth arched body portion. Again, the overall impact-attenuation member structure may be symmetrical or asymmetrical (e.g., due to differences in the body portions, etc.) without departing from this invention.

In at least some example structures according to this aspect of the invention, the first arched body portion may include a first rounded edge and a second rounded edge, wherein the first and second rounded edges of the first arched body portion provide movable engagement with the first spring member. Likewise, the second arched body portion may include a first rounded edge and a second rounded edge, wherein the first and second rounded edges of the second arched body portion provide movable engagement with the first spring member. The rounded edges of the body portions may lie opposite one another, optionally facing one another on opposing sides of the spring member. Again, the body portions may be the same as, mirror images of, or different from one another, and the individual body portions may be symmetrical or asymmetrical without departing from this invention.

Example impact-attenuation member structures in accordance with this invention also may be engaged with another element, such as a base member, a base plate, a structural component of an article of footwear, a structural component of another foot-receiving device product, and the like. If desired, the impact-attenuation member(s) may include the additional element(s) and form a heel cage or heel unit for mounting in an article of footwear or other foot-receiving device product, for attaching to an article of footwear or other foot-receiving device product, etc. Optionally, if desired, the impact-attenuation member or at least some portion thereof (e.g., the spring member, the body portions, etc.) may be removably and/or releasably engaged with these other members or structures, e.g., to enable removal, exchange, re-orientation, and the like, of the impact-attenuation member and/or portions thereof with respect to the element to which it is mounted.

2. Foot-Receiving Device Products Including Impact-Attenuation Members and Methods of Making and Using Such Products Additional aspects of this invention relate to foot-receiving device products, such as articles of footwear (including athletic footwear), that include impact-attenuation members, e.g., of the types described above. As a more specific example, foot-receiving device products, such as articles of footwear, in accordance with at least some examples of this invention may include: (a) a foot-covering member (such as an upper member for an article of footwear); (b) a foot-supporting member (such as a sole structure for an article of footwear) engaged with the foot-covering member; and (c) one or more impact-attenuation members engaged with at least one of the foot-covering member or the foot-supporting member. The impact-attenuation member(s) may have a wide variety of structures and features, including any of the various structures and features described above.

The impact-attenuation member(s) may be located at any desired position in a foot-receiving device product structure. For example, in accordance with at least some examples of this invention, the impact-attenuation member(s) may be located in a heel area, a toe area, and/or other areas of an article of footwear or other foot-receiving device product, e.g., as part of the sole structure or foot-supporting member structure. Also, the impact-attenuation member(s) may be incorporated into a foot-receiving device product in any desired manner without departing from this invention. For example, if desired, the impact-attenuation member(s) may be included at locations and orientations so as to be at least partially visible from an exterior of the article of footwear, e.g., akin to commercial products available from NIKE, Inc., of Beaverton, Oreg. under the "SHOX" brand trademark. Alternatively, if desired, the impact-attenuation member(s) may be hidden or at least partially hidden in the overall footwear or foot-receiving device product structure, such as within the foam material of a midsole element, within a gas-filled bladder member, etc. Also, any number of individual impact-attenuation member structures may be included in an article of footwear or other foot-receiving device product without departing from this invention.

Still additional aspects of this invention relate to methods of making footwear or other foot-receiving device products including impact-attenuation members in accordance with examples of this invention and methods of using such impact-attenuation members and/or such products, e.g., for attenuating contact surface reaction forces. Such methods may include constructing an article of footwear or other foot-receiving device product, e.g., by any desired method, including conventional methods that are known and used in the art, wherein one or more impact-attenuation member according to the invention is incorporated into the footwear or other product structure (e.g., as a portion of a sole member, in the heel or toe area of the article of footwear, etc.). Once incorporated in the footwear or other product structure, the article of footwear or other product may be used in its known and conventional manner, and the impact-attenuation member will attenuate the ground reaction forces (e.g., from landing a step or jump). In addition, at least some example impact-attenuation member structures in accordance with this invention also may resist shear or lateral forces and/or movement or collapse of the impact-attenuation member (e.g., during direction changes, cutting actions, and the like).

Specific examples of structures according to the invention are described in more detail below. The reader should understand that these specific examples are set forth merely to illustrate examples of the invention, and they should not be construed as limiting the invention.

D. SPECIFIC EXAMPLES OF THE INVENTION

The various figures in this application illustrate examples of impact-attenuation members, as well as products and methods according to examples of this invention. When the same reference number appears in more than one drawing, that reference number is used consistently in this specification and the drawings to refer to the same or similar parts throughout. In the description above and that which follows, various connections and/or engagements are set forth between elements in the overall structures. The reader should understand that these connections and/or engagements in general and, unless specified otherwise, may be direct or indirect and that this specification is not intended to be limiting in this respect.

Figure 1B:
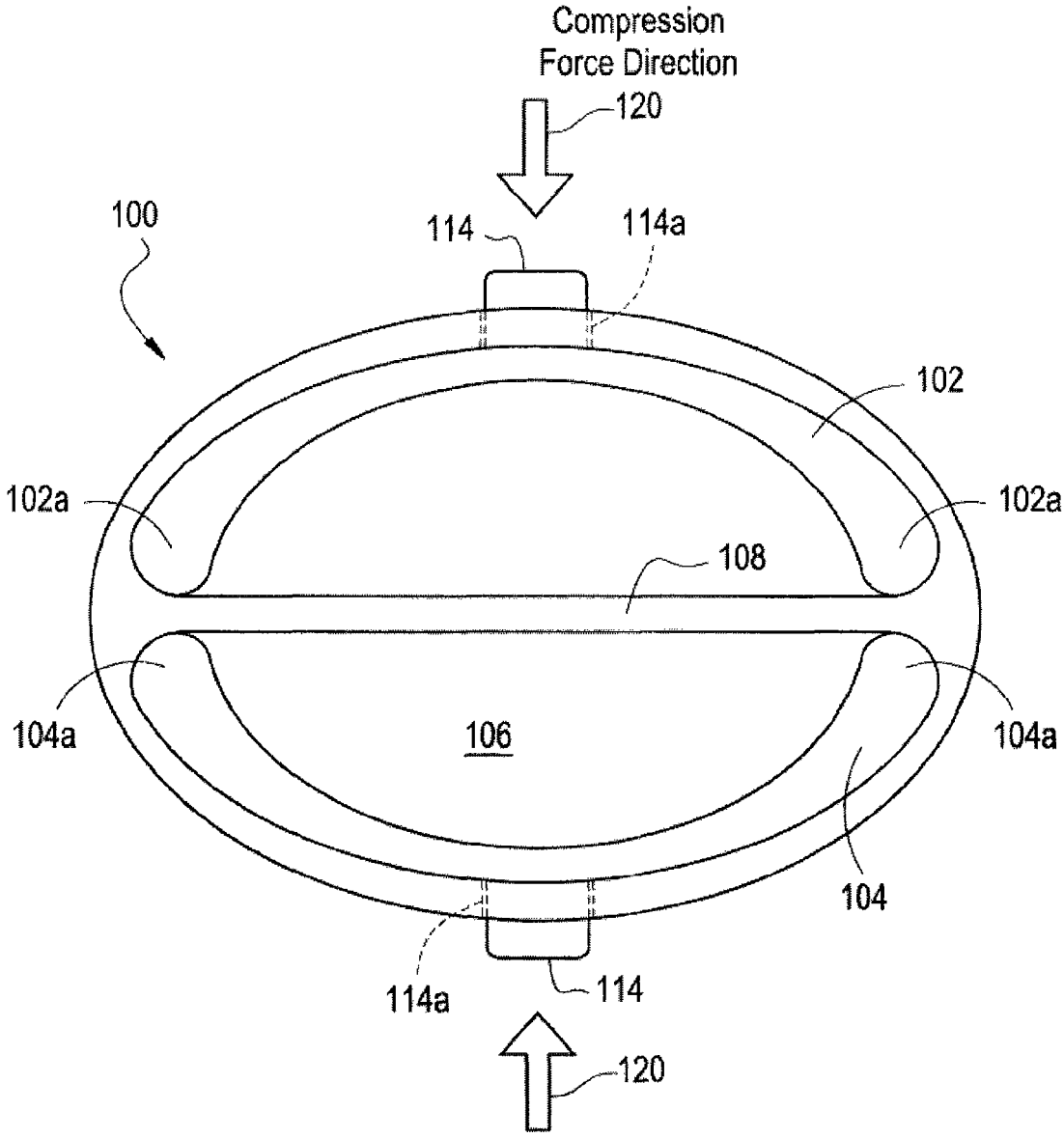
Figure 1C:
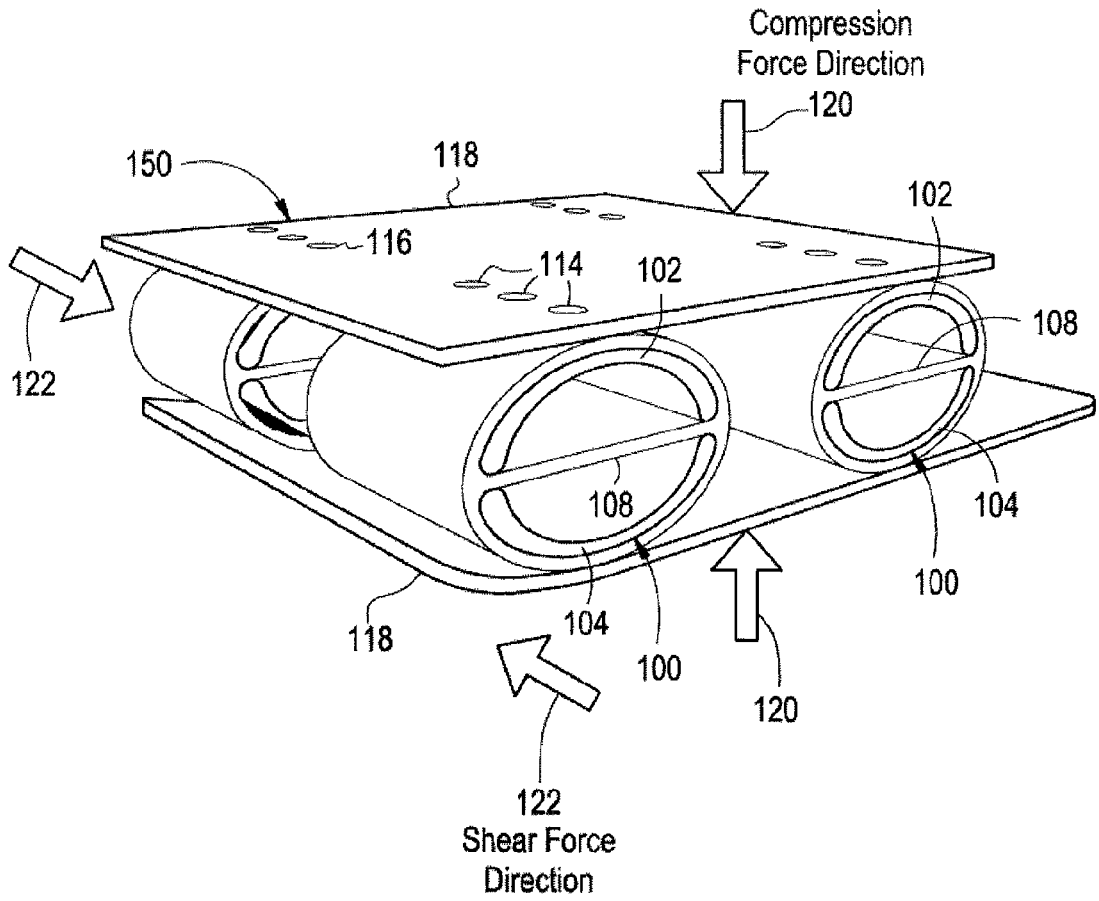

FIGS. 1A through 1C illustrate an impact-attenuation member structure 100 in accordance with some examples of this invention. In this example structure 100, arched body portions or members 102 and 104 are arranged facing one another such that an open space 106 is defined therebetween. A stretchable spring member 108 extends through the open space 106 and movably (e.g., rotatably or pivotally) engages the rounded ends 102*a* and 104*a* of the body members 102 and 104, respectively. The spring member 108 in this example structure 100 further extends outside the open space 106 and around the exterior surfaces of the body members 102 and 104 so as to at least partially, and in some examples, so as to substantially, enclose or contain the body members 102 and 104 (e.g., the terms "substantially enclose" or "substantially contain" in this context, mean that the spring member 108 extends around and encloses or covers at least 50% of the outer surface area of body members 102 and 104). In the illustrated example structure 100, the spring member 108 encloses substantially the entire exterior surface of body members 102 and 104 (e.g., greater than 75% of the exterior surface, and even greater than 90% or 95% of the exterior surface). In any event, in at least some examples, the spring member 108 may at least partially contain or enclose the body portions 102 and/or 104 to a sufficient extent or degree so that a stable chemical (e.g., adhesive or cement) or other connection may be made and maintained between the spring member 108 and the body portions 102 and/04 104. Notably, the example impact-attenuation member 100 shown in FIGS. 1A through 1C does not require direct connection between the body portions 102 and 104 and/or the presence of separate pivot shafts, hinges, cam members, or the like.

The body members 102 and 104 may be made from any suitable or desired material, such as plastic, elastomeric, or polymeric materials capable of changing shape, size, and/or orientation when a force is applied thereto and returning back to or toward their original shape, size, and/or orientation when the force is relieved or relaxed. As more specific examples, the body members 102 and 104 (as well as the body portions or members of other example structures described in this specification) may be made from a polymeric material, such as PEBAX® (a polyether-block co-polyamide polymer available from Atofina Corporation of Puteaux, France). If desired, a single or one-piece body member structure may be used that includes body portions that define an open area 106, or the individual body members 102 and/or 104 each may be constructed from multiple pieces, without departing from this invention. Also, while the body members 102 and 104 in the illustrated example structure 100 are arched, those skilled in the art will appreciate that semicircular, semi-oval, semi-elliptical, hemispherical, or other shapes may be used and/or define an area for open space 106 without departing from this invention. If desired, the various "arched" structures described above may include flat or substantially flat top portions, e.g., to facilitate engagement with or mounting to other structures.

As illustrated in FIGS. 1A through 1C, the body members 102 and 104, at least in part, may define a base or neutral orientation for the impact-attenuating member 100 (e.g., an orientation at which no significant external forces are applied to the impact-attenuating member 100 other than forces applied by the components of the member 100 and/or the components of any device in which the member 100 is mounted or housed (such as a piece of footwear or other foot-receiving device)). In other words, in its base or neutral orientation, no external force is applied to the impact-attenuating member 100 by the user, for example, as a result of walking, running, or jumping (although the impact-attenuating member 100 may support the user's weight and still be considered as being in its neutral or base orientation).

As described above, spring member 108 extends across and is at least partially included in the open space 106. In the base orientation in this illustrated example structure 100, the spring member 108 tautly extends across the open space 106 defined between the body members 102 and 104 at essentially a central location between the body members 102 and 104. In at least some examples of the invention, forces applied to the overall impact-attenuation member 100 by the spring member 108 may be included as part of the forces that define the base or neutral orientation for the impact-attenuation member 100.

Any suitable or desired spring member 108 structure and/or orientation may be included in the impact-attenuation member structure 100 without departing from this invention. In this illustrated example, the spring member 108 is a synthetic or natural rubber or polymeric material (such as an elastomeric material) that is capable of stretching under tensile force and then returning (or substantially returning) to or toward its original size and shape when the force is relieved or relaxed. As a more specific example, the spring member 108 (as well as the spring members of other example structures described in this specification) may be made from a polymeric material, such as DESMOPAN® (a thermoplastic polyurethane material available from Bayer AG of Leverkusen, Germany). The size, construction, orientation, material, and/or other properties of the spring member 108 may be freely selected and varied, e.g., to change the overall stiffness, rebound, and/or spring constant characteristics of the impact-attenuation member 100.

The spring member 108 may be engaged with respect to at least one of the body members 102 and/or 104, as noted above, in a relatively movable manner (e.g., pivotal or rotatable manner). In the example structure 100 illustrated in FIGS. 1A through 1C, when a force 120 is applied that compresses body members 102 and 104 together and toward one another (e.g., when a wearer lands a step or jump), the rounded ends 102*a* and 104*a* of these body members 102 and 104, respectively, pinch together and pivot or rotate somewhat with respect to the spring member 108, which stretches the spring member 108 outward under the force of the pinching and flattening body members 102 and 104. When the compressive force 120 is relieved or relaxed, the spring member 108 tends to constrict back toward its original orientation and configuration, thereby, in at least some instances, pulling body members 102 and 104 (as well as the overall impact-attenuation member device 100) back toward their original or base orientations and configurations. The material and structure of the body members 102 and 104 also may assist in bringing the overall structure back toward its original orientation.

The spring member 108 in the illustrated example includes openings or holes 114*a* defined therein so that mounting elements 114, e.g., pins 114, included on the exterior surface of the body members 102 and 104 may extend through the spring member 108 and may be used to fix the position of the impact-attenuation member 100. For example, as illustrated in FIG. 1C, mounting elements 114 may fit into holes 116 defined in base members 118 so that the impact-attenuation members 100 can be securely mounted between the base members 118. As further illustrated in FIG. 1C, one or more impact-attenuation members 100 may be mounted to or between one or more base members 118 to provide an impact-attenuation system 150 that may be inserted as a unit (e.g., a "heel cage unit") into another device, such as into a heel area or other area of a piece of footwear or other foot-receiving device. Alternatively, if desired, the base members 118 may constitute a portion of an overall structure to which the impact-attenuation members 100 are mounted, such as a plate included in an outsole or midsole structure of an article of footwear.

Rather than being included as part of the body members 102 and 104, the mounting elements 114, if any, may be formed as part of the spring member 108 and/or they may be separate elements attached to the spring member 108 and/or the body member structures 102 and 104 in some manner. Additionally, the mounting elements 114 may be constructed of any suitable or desired material, in any desired shape, and/or provided at any desired locations, without departing from the invention. For example, the mounting elements 114 may be formed as ribs that are received in tracks, grooves, or openings defined in base members 118, and vice versa.

In addition to providing impact-attenuation (against substantially vertical forces, forces 120 experienced when landing a step or jump, etc.) and optionally "spring back" properties, this example structure 100 in accordance with the invention provides resistance against shear or lateral forces 122 (e.g., against substantially horizontal forces, in the side-to-side directions, in the medial side-to-lateral side direction in an article of footwear or other foot-receiving device product, etc.). Resistance to shear or lateral forces and lateral stability of this type can help prevent the overall impact-attenuation member structure 100 from collapsing, e.g., when a user makes quick direction changing actions, "cuts," starts, and/or stops, etc. Resistance to the shear or lateral forces 122 in this example structure 100 may be provided by the body members 102 and 104, which may be constructed from rigid, structurally stable materials (e.g., plastics, like those described above) arranged to extend in substantially the horizontal, side-to-side direction when the member 100 is mounted in an article of footwear or other foot-receiving device product. In this illustrated example structure 100, the body members 100 include surfaces extending in a direction substantially parallel to the expected direction of the lateral or shear force 122. These extended surfaces and the overall orientation and construction of the body members 102 and 104 make the overall structure 100 stable against lateral and shear forces 122 and resistant to collapse or failure under such forces 122.

Figure 2A:
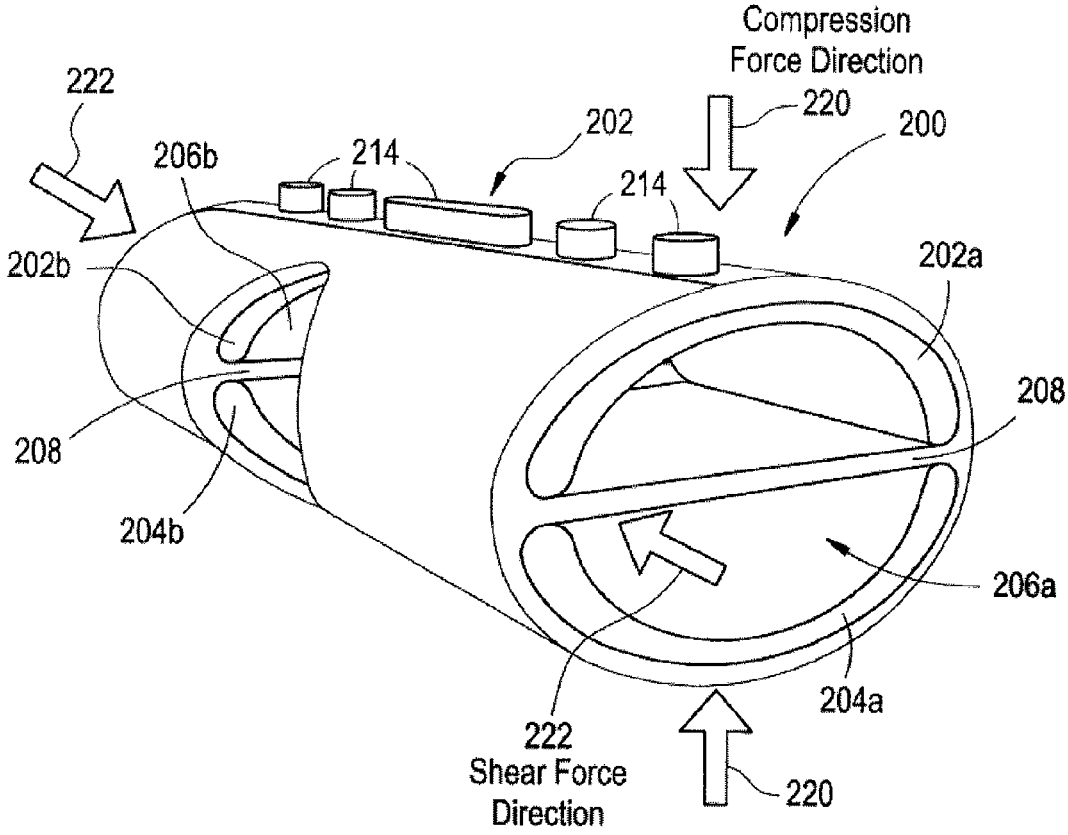
FIGS. 2A, 2B, and 3 illustrate additional example impact-attenuation member structures in accordance with this invention.
Figure 2B:
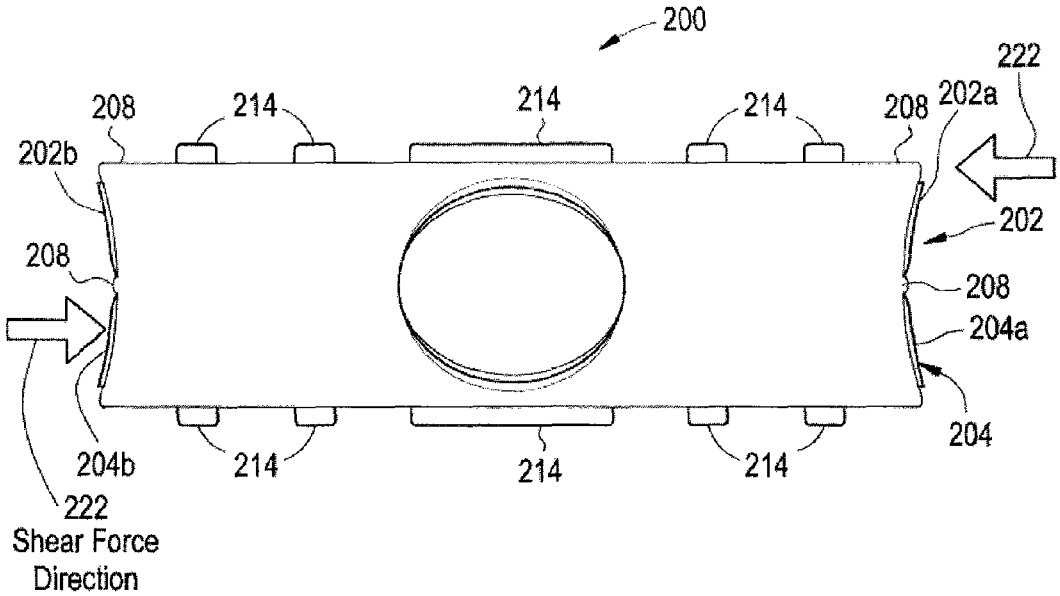

FIGS. 2A and 2B illustrate another example impact-attenuation member structure 200 of the general type illustrated in FIGS. 1A through 1C. In this example structure 200, a first arched body portion or member 202 provides two separate body areas 202*a* and 202*b*, and a second arched body portion or member 204 provides two separate body areas 204*a* and 204*b* facing the first body areas 202*a* and 202*b*. A single spring member 208 extends through the open spaces 206*a* and 206*b* defined between the spring body areas 202*a*, 202*b*, 204*a*, and 204*b*. Plural mounting elements 214, optionally of various sizes and shapes, may be provided as part of the body members 202 and/or 204, although, as described above in conjunction with FIG. 1C, the mounting elements 214 may be provided as part of the spring member 208, as separate attached element(s), or not at all without departing from the invention. The example impact-attenuation member 200 of FIGS. 2A and 2B may be used and operated in essentially the same manner as the example impact-attenuation member 100 illustrated in FIGS. 1A through 1C.

In the example structure 200 illustrated in FIGS. 2A and 2B, a single spring member 208 extends through the open spaces 206*a* and 206*b* defined between the body areas 202*a*, 202*b*, 204*a*, and 204*b* and around the exterior surfaces of the body members 202 and 204. Alternatively, if desired, each open space 206*a* and 206*b* could include a separate spring member 208 or multiple spring members 208 for just that area. As another alternative, a single spring member 208 could extend to at least partially and/or substantially cover or enclose two completely independent sets of body portions or members (e.g., body areas 202*a* and 202*b* and/or body areas 204*a* and 204*b* need not be formed from a single piece of material, but they could be formed from independent pieces of material). Other variations in the structure and construction of the spring member, body members, and/or other portions of the impact-attenuation member structure 200 are possible without departing from the invention.

Figure 3:
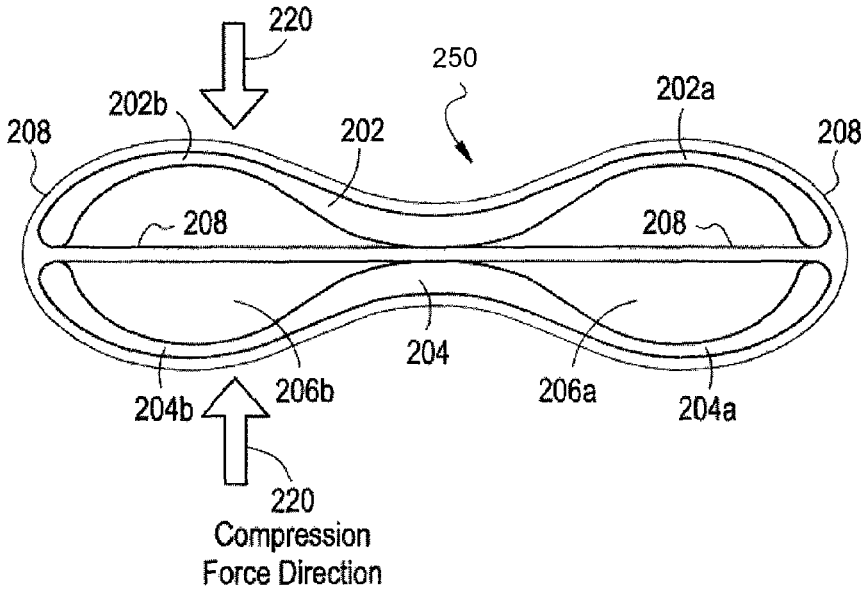

In the example structure 200 of FIG. 2A, the two open spaces 206*a* and 206*b* (and hence the body areas 202*a*, 202*b*, 204*a*, and 204*b*) are arranged laterally, side-by-side (e.g., aligned in a first direction). Other arrangements are possible without departing from the invention. For example, FIG. 3 illustrates an arrangement similar to that shown in FIGS. 2A and 2B, except in the structure 250 of FIG. 3, the open spaces 206*a* and 206*b* are arranged in a front-to-back relationship (e.g., aligned in a second direction generally perpendicular to the first direction). In at least some examples, the structure 200 of FIGS. 2A and 2B is well suited to extend in a lateral direction across a footwear or foot-receiving device structure (e.g., from the lateral side to the medial side in the heel area) whereas the structure 250 of FIG. 3 is well suited to extend in a front-to-rear direction (or longitudinal direction) in a footwear or foot-receiving device structure (e.g., in the heel area). Of course, other arrangements of the structures 200 and/or 250 in a foot-receiving device product are possible without departing from this invention.

As noted above, and for the reasons described above in conjunction with FIGS. 1A through 1C, the structures 200 and 250 of FIGS. 2A, 2B, and 3 can provide excellent impact-attenuation characteristics (against substantially vertical forces, forces 220 experienced when landing a step or jump, etc.) and optionally "spring back" properties, while also still providing resistance against shear or lateral forces 222 (e.g., against substantially horizontal forces, in the side-to-side directions, in the medial side-to-lateral side direction in an article of footwear or other foot-receiving device product, etc.). This may be accomplished, for example, when the structure 200 is mounted in an article of footwear or other foot-receiving device such that the width of the body members 202 and 204 extend in a direction substantially parallel to an expected direction of the lateral or shear force 222, as shown in FIGS. 2A and 2B. Additionally, lateral stability may be provided in the structure 250 of FIG. 3 by arranging the body members 202 and 204 such that their width direction (into and out of the page of FIG. 3) extends in the lateral, side-to-side direction of a footwear or foot-receiving device structure.

Additional aspects of this invention relate to methods for providing footwear or foot-receiving devices including impact-attenuation members, e.g., of the types described above. If desired, the "stiffness" or other impact-attenuation characteristics of articles of footwear, foot-receiving devices, and/or individual impact-attenuation members according to examples of this invention can be controlled and/or changed, for example, by selecting structural or other features of the various elements of the impact-attenuation member so as to provide different stiffness or other impact-attenuating characteristics (e.g., by changing the material of the spring member, changing the construction of the spring member, changing the number of spring members, changing the thickness of the spring members, etc.); by selecting body portions or members having different characteristics (e.g., by selecting different body member materials, different body member thicknesses, different body constructions (e.g., ribbed outer surface v. smooth outer surface, arch angle, arch width, etc.)); etc.

Various factors may be taken into consideration when determining the specific characteristics of spring member(s), body portion(s) or member(s), and/or the overall impact-attenuation member(s) to place in a given article of footwear or other foot-receiving device. For example, characteristics of the spring member(s), the body portion(s) or member(s), and/or the overall impact-attenuation member(s) may be selected based on one or more characteristics of the intended end user, such as: the user's weight, the user's shoe size, the user's foot width, the user's anticipated moving speed, the user's anticipated jumping ability, the user's gait or stride (e.g., a pronation or supination tendency, etc.), and the like. Also, different spring member(s), body portion(s) or member(s), and/or overall impact-attenuation member(s) may be selected depending on the final intended end use of the footwear or other foot-receiving device product. For example, different impact attenuation member(s) and/or one or more portions thereof (e.g., to produce different stiffnesses) may be selected depending on whether the footwear or foot-receiving device is used for walking, running, basketball, soccer, football, baseball, softball, sprinting, track events, field events, cross-training, video game play, training exercises, etc.

The potential variability features allow manufacturers, wholesalers, retailers, users, or others to selectively determine and/or change the stiffness or impact-attenuation characteristics of an article of footwear or other foot-receiving device product by selecting different impact-attenuation members and/or portions thereof for inclusion in the footwear or other product. In this manner, if desired, manufacturers, wholesalers, retailers, users, or others can customize a pair of footwear or other foot-receiving device, e.g., based on one or more characteristics of the intended user and/or one or more characteristics of the ultimate intended end use of the product. Moreover, this customization can take place at any stage in the distribution chain, for example, at the construction factory by the manufacturer, by wholesalers or retailers (e.g., at a warehouse or a point of sale location, to replenish depleted stock, etc.), by consumers at the time and/or after the product has been purchased, etc. As one example, the characteristics of the impact-attenuation member(s) and/or portions thereof may be selected at the assembly factory for a given pair of shoes, and these shoes may then be marketed specifically targeted to specific users or use characteristics (e.g., the sales box and/or a tag on the shoe might indicate that the shoe is designed for running or jogging for a user between 165 and 180 lbs.). Shoes for a series of different uses, for different user weights (or other characteristics), and/or of different firmness levels then may be marked on boxes or tags (depending on the characteristics of the impact-attenuation member used) and placed in the market.

As another example, shoe retailers or wholesalers may have a supply of impact-attenuation members or portions thereof available to insert into the footwear or foot-receiving device at the point of sale location, e.g., based on the characteristics of the intended user, the intended use, and/or to replenish depleted stock. As still another example, users may be allowed to freely select and/or change impact-attenuation members or portions thereof, based on their immediate needs and/or the characteristics they desire in the footwear or foot-receiving devices at a given time and/or for a given activity (e.g., by switching one or more impact-attenuation members or portions thereof for others at a point of use location). Inpact-attenuation members (or portions thereof) labeled with various different characteristics (e.g., for different user characteristics or intended use characteristics as described above) may be made available to users. These aspects of the invention work particularly well for footwear and foot-receiving device constructions in which the impact-attenuation members remain visible and/or are otherwise easily accessible by the user after the device is fully assembled.

As still another example, methods according to aspects of the invention further may include providing at least an upper member (or other foot-covering member) and a sole member (or other foot-supporting member) for an article of footwear or other foot-receiving device product. Based at least in part on a characteristic of an intended user of the article of footwear or the device or a characteristic of an intended use of the article of footwear or device, at least a portion of an impact-attenuation member may be selected or identified for inclusion in the article of footwear or in the device. As mentioned above, this selection may occur, for example, at the manufacturing location, at a wholesaler location, at a retailer location, after retail purchase, at a point of use location, etc. The impact-attenuation member may be included at the desired location in the article of footwear or other foot-receiving device, e.g., between the upper member and the sole member, engaged (directly or indirectly) with at least a portion of the upper member and/or the sole member, etc.

If desired, a user may change the characteristics of an article of footwear or other foot-receiving device by removing one or more of the impact-attenuation members and/or portion(s) thereof and replacing it/them with new impact-attenuation members or portions thereof. This feature also can be used to replace broken impact-attenuation members, to customize a foot-receiving device for a new user, customize a foot-receiving device for changing user or use conditions, etc.

Figure 4A:
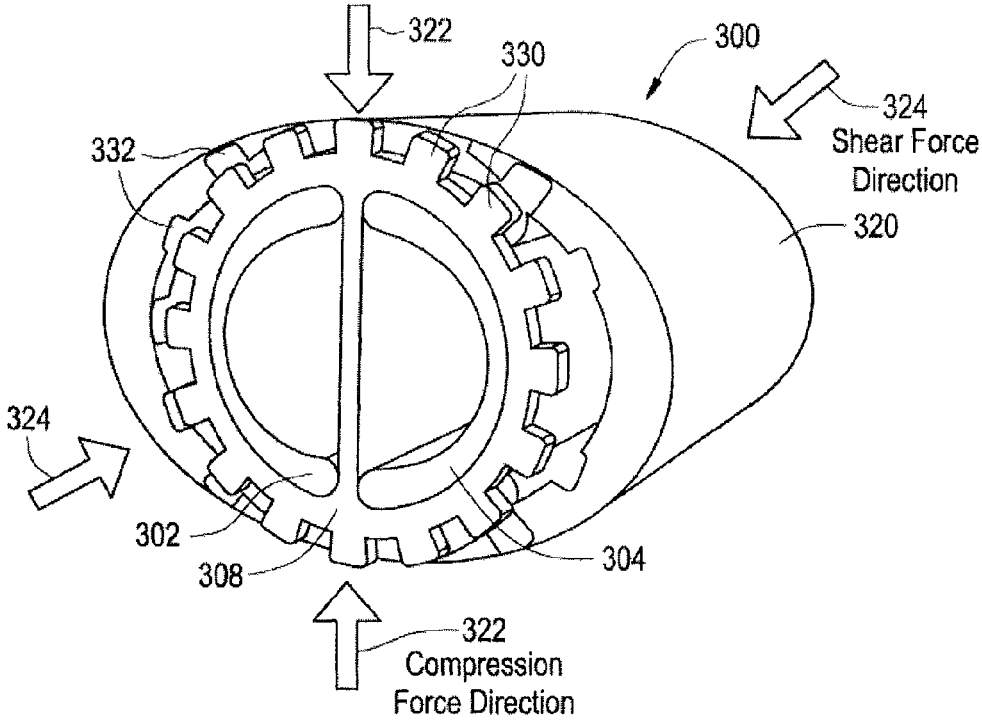
FIGS. 4A and 4B illustrate another example impact-attenuation member structure in accordance with this invention.
Figure 4B:
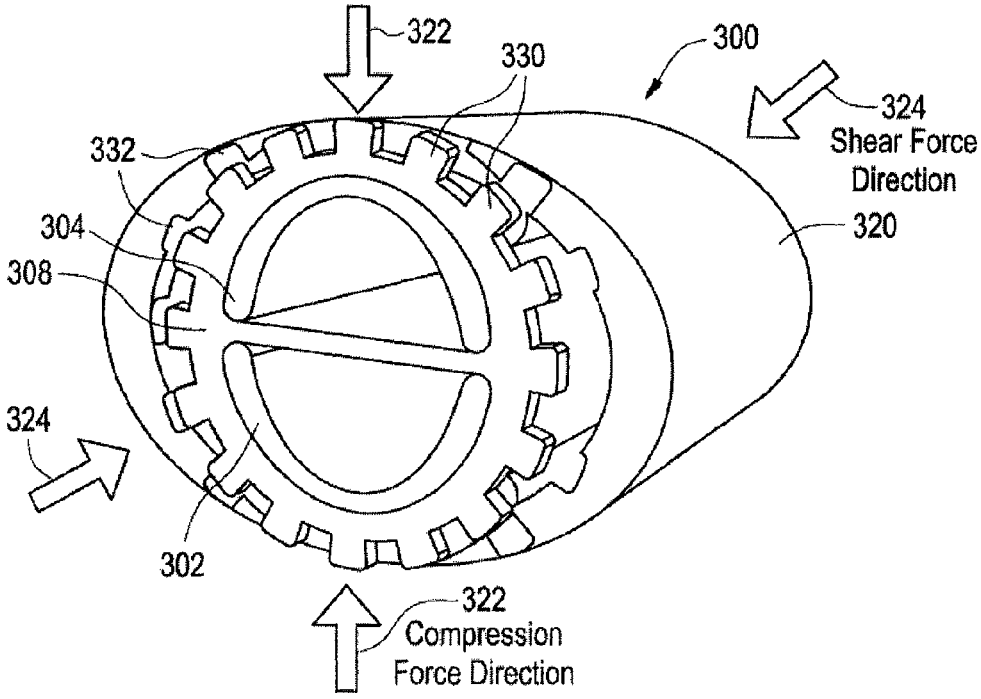

Rather than replacing an impact-attenuation member or portion thereof with a different one, if desired, in accordance with at least some examples of this invention, impact-attenuation, stiffness, feel, and/or other characteristics of an article of footwear or other foot-receiving device product may be altered by changing an orientation of an impact-attenuation member or a portion thereof with respect to the article of footwear or other product. FIGS. 4A and 4B illustrate an example. FIGS. 4A and 4B illustrate an example impact-attenuation member 300, e.g., of the general type described above in conjunction with FIGS. 1A through 1C. The impact-attenuation member 300 may be releasably engaged with one or more base members 320, and the impact-attenuation member 300 may be sized, shaped, and/or otherwise configured such that it can be removed from and/or reoriented with respect to the base member(s) 320 in a plurality of different ways. In the example orientation illustrated in FIG. 4A, the impact-attenuation member 300 would be relatively "soft" with respect to forces 322 acting in a generally vertical direction (e.g., forces experienced when a wearer lands a step or jump, etc.). The softer "feel" may be due, at least in part, to the vertical arrangement of the spring member 308 in the central region between the body portions 302 and 304 (e.g., the impact forces 322 need not stretch the spring member 308 at its central location, and the body members 302 and 304 are arranged to bend relatively easily). When removed and reoriented with respect to the base member(s) 320 in the manner illustrated in FIG. 4B, on the other hand, the impact-attenuation member 300 would be relatively "firm" or "hard" with respect to forces 322 acting in a generally vertical direction (e.g., forces experienced when a wearer lands a step or jump, etc.), e.g., due, at least in part, to the need to stretch the spring member 308 across the central open area. Wearers may be allowed to freely reorient or replace the impact-attenuation member 300, e.g., based on an expected use, based on personal characteristics or preferences, etc.

Of course, any manner of engaging the impact-attenuation member 300 with the base member(s) 320 is possible without departing from the invention. For example, the exterior surface of the spring member 308 and/or the body portions 302 and/or 304 may include ribs, ridges, and/or other structures that engage with grooves, openings, and/or recesses formed in the base member(s) 320 interior surface (or vice versa). In this illustrated example structure 300, ridges 330 provided around the exterior surface of the spring member 308 engage grooves 332 provided in the interior surface of the base member 320. Because ridges 330 are provided at spaced locations around the entire exterior of the circular spring member structure 308, the impact-attenuation member 300 may be engaged with and oriented with respect to the base member 320 in many different orientations, to thereby provide a variety of different potential impact-attenuation characteristics or "feels." As additional and/or alternative examples, if desired, mechanical connectors, retaining elements, adhesives, a tight friction fit, and the like may be used to hold the impact-attenuation member(s) 300 in place with respect to the base member(s) 320. Also, any number of base members 320 and impact-attenuation members 300, in any desired combinations of impact-attenuation members 300 with respect to base members 320, may be used without departing from this invention (e.g., one base member 320 or base member set may engage any number of impact-attenuation members 300, and one impact-attenuation member 300 may engage one or multiple base members 320 without departing from this invention).

Again, the structure, arrangement, and/or materials of the body portions 302 and 304 provide stability against lateral or shear forces 324, while providing adjustable, customizable, impact-attenuation properties as described above. This may be accomplished, for example, by arranging the impact-attenuation member 300 such that the body portions 302 and 304 extend in a direction substantially parallel to the expected direction of the shear or lateral force 324. The base member(s) also may be used to provide lateral stability.

Figure 5A:
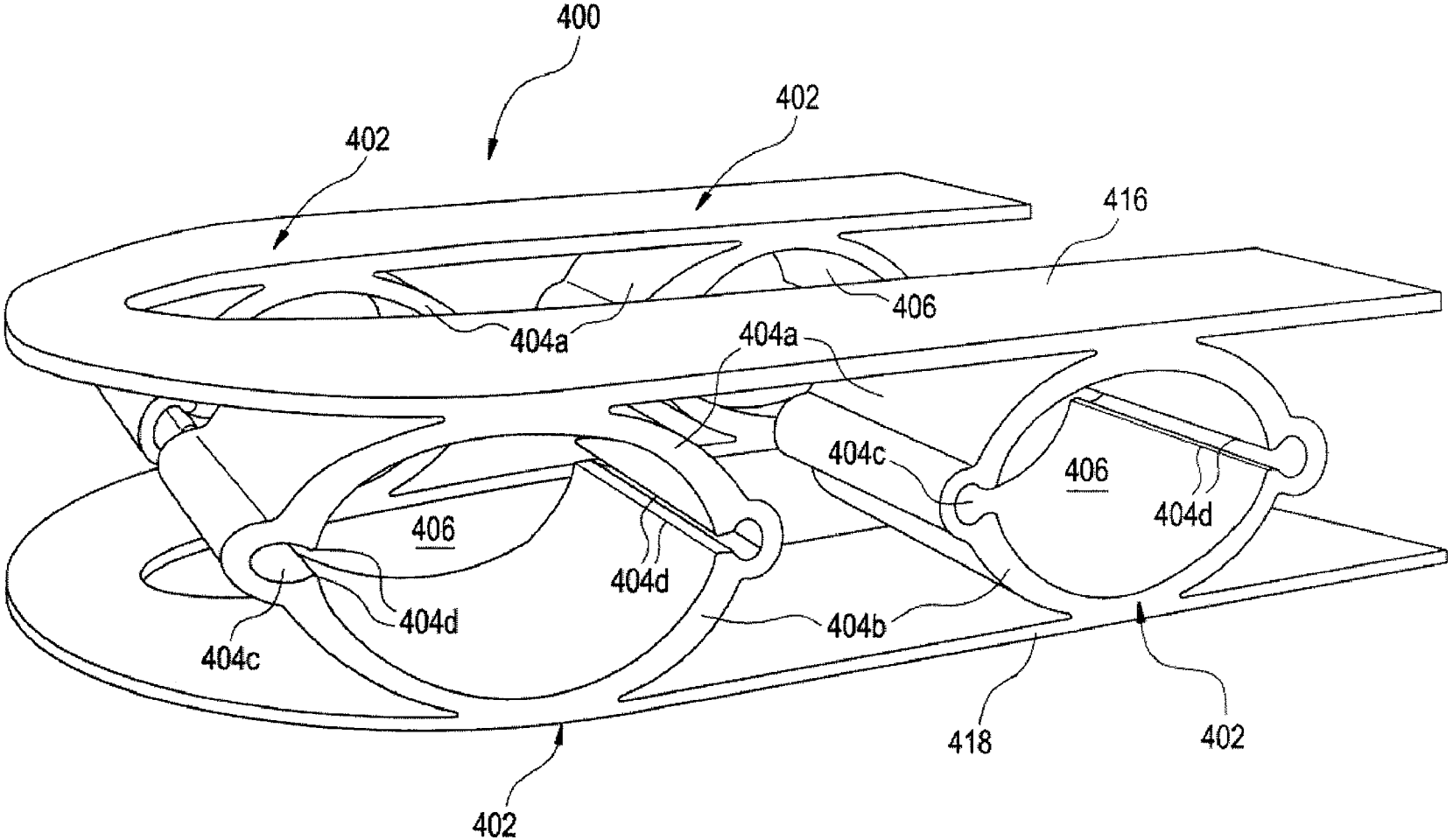
FIGS. 5A and 5B illustrate another example impact-attenuation member structure in accordance with this invention.
Figure 5B:
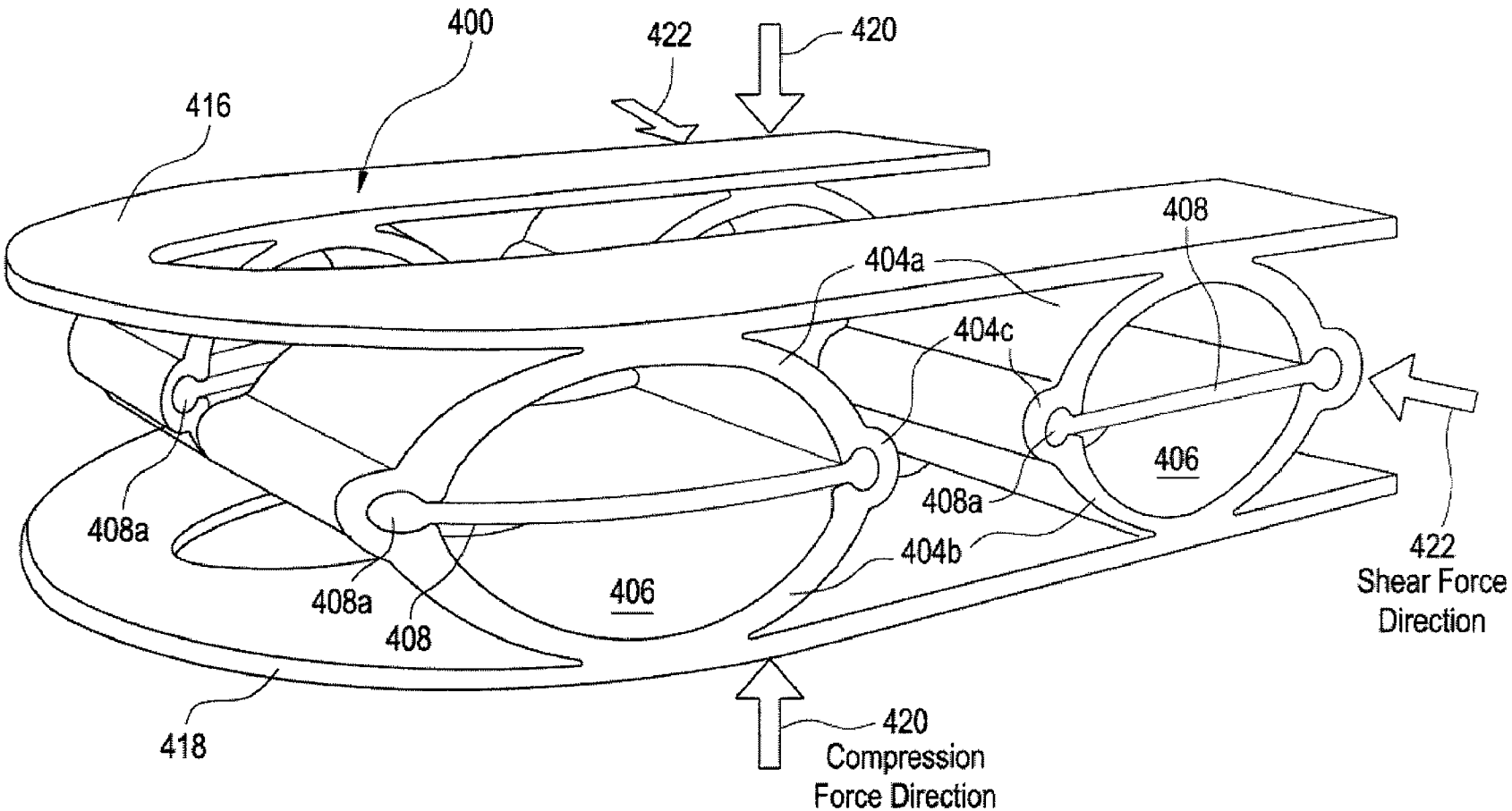

In the specific example impact-attenuation member structures described above, the body portions of the impact-attenuation members were made from individual and independent pieces of material. This is not a requirement. FIGS. 5A and 5B illustrate an example impact-attenuation member system 400 including four individual impact-attenuation structures or areas 402. Each impact-attenuation area 402 includes an upper body portion 404*a* and a lower body portion 404*b*, arranged facing one another such that an open space 406 is defined between the body portions 404*a* and 404*b*. In this example structure 400, as shown, the body portions 404*a* and 404*b* are formed as a single piece, unitary construction. Furthermore, in the illustrated example structure 400, four impact-attenuation areas 402 are provided between base members 416 and 418 to provide a unitary construction (e.g., a "heel unit") that may be fit into an article of footwear, another foot-receiving device, and/or any other desired device. The impact-attenuation areas 402 may be fixed with the base members 416 and 418 in any desired manner without departing from the invention, for example, by cements, by adhesives, by unitary one-piece construction (e.g., by molding, etc.), by mounting pegs or ribs, other mechanical connectors, etc. Of course, any number of impact-attenuation areas 402 may be provided in the overall system 400 without departing from the invention, including one or more areas 402. Alternatively, if desired, the upper body portion 404*a* and the lower body portion 404*b* may be made from individual independent pieces, optionally joined together in any desired manner (e.g., via adhesives, mechanical connectors, shaft members, fusing techniques, friction fit structures, etc.), without departing from the invention.

FIG. 5B further illustrates the impact-attenuation system 400 of FIG. 5A with spring members 408 extending across the open spaces 406 between the body portions 404*a* and 404*b*. As shown, these example spring members 408 include expanded ends or bulbs 408*a* that fit into corresponding recesses or chambers 404*c* defined by the body portions 404*a* and 404*b*. Additionally, in at least some examples, the openings to the recesses 404*c* will define rounded edges 404*d* that may, at least in part, pinch the spring member 408, as will be described below. Of course, other ways of engaging the spring member 408 and the body portion(s) 404*a* and/or 404*b* may be used without departing from this invention.

The body portions 404*a* and 404*b* may be constructed from any desired materials, including any materials that can deform somewhat under applied force and return to or toward their original size, shape, and orientation when the force is relaxed or removed, including the various materials described above for use with body members 102 and 104. Likewise, the spring members 408 may be made from any desired materials, including any materials that stretch somewhat under tensile force and return to or toward their original size, shape, and orientation when the force is relaxed or removed, including the various materials described above for use as spring members 108.

In use, when a compressing force 420 acts to compress the open area 406 between the body portions 404*a* and 404*b* (e.g., from landing a step or jump, which tends to flatten the impact-attenuation areas 402), the rounded edges 404*d* will pinch together on the spring member 408 and move (e.g., pivot or rotate) somewhat with respect to the spring member 408. This movement and pinching action while the impact-attenuation areas 402 flatten acts to stretch the spring member 408 in the open area 406 between the recesses 404*c*. Then, as the force 420 is relieved or relaxed, the spring member 408 will return to its original or to substantially its original size, shape, and orientation. As the spring member 408 contracts toward its original size, shape, and orientation, the expanded ends or bulbed areas 408*a* of the spring member 408 will pull back on the edges 404*d* of the body portions 404*a* and 404*b*, to thereby help return the entire impact-attenuation areas 402 back toward their original size, shape, and orientation.

The impact-attenuation system 400 and arrangements illustrated in FIGS. 5A and 5B have advantages in that the body portions 404*a* and 404*b* of the impact-attenuation areas 402 may be made from a one piece construction, if desired, thus eliminating the need for separate hinges, pins, shaft elements, or mechanical connectors and the construction of such areas. Nonetheless, the spring members 408 (e.g., enlarged ends 408*a*) may be sized with respect to the remainder of the body portions (e.g., receptacles 404*c*) so that the spring member 408 may be removed and replaced (e.g., by sliding the spring members 408 in to and out of their receptacles 404*c*, etc.), if desired, for example, to customize the structure 400 for intended use and/or user characteristics, as described above, to replace a broken spring member 408, etc.

In addition to providing impact-attenuation (against substantially vertical forces, forces 420 experienced when landing a step or jump, etc.) and optionally "spring back" properties, this example structure 400 in accordance with the invention also may provide resistance against shear or lateral forces 422 (e.g., against substantially horizontal forces, in the side-to-side directions, in the medial side-to-lateral side direction in an article of footwear or other foot-receiving device product, etc.). Resistance to shear or lateral forces 422 of this type can prevent the various portions of the impact-attenuation structure 400 from collapsing or rolling over, e.g., when a user makes quick direction changing actions, makes "cuts," takes quick starting and/or stopping actions, etc. Resistance to the shear or lateral forces in this example structure 400 may be provided, at least in part, by the body portions 404*a* and 404*b*, which may be made from rigid, structurally stable materials (e.g., plastics, like those described above) and arranged to extend in substantially the horizontal, side-to-side direction when the member 400 is mounted in an article of footwear or other foot-receiving device product. In this illustrated example structure 400, the body portions 404*a* and 404*b* include surfaces extending in a direction substantially parallel to the expected direction of the lateral or shear forces 422. These extending surfaces and the construction of the body portions 404*a* and 404*b* make the overall structure 400, as well as the individual impact-attenuating regions 402, stable against lateral and shear forces 422 and resistant to collapse or failure under such forces 422.

Figure 6:
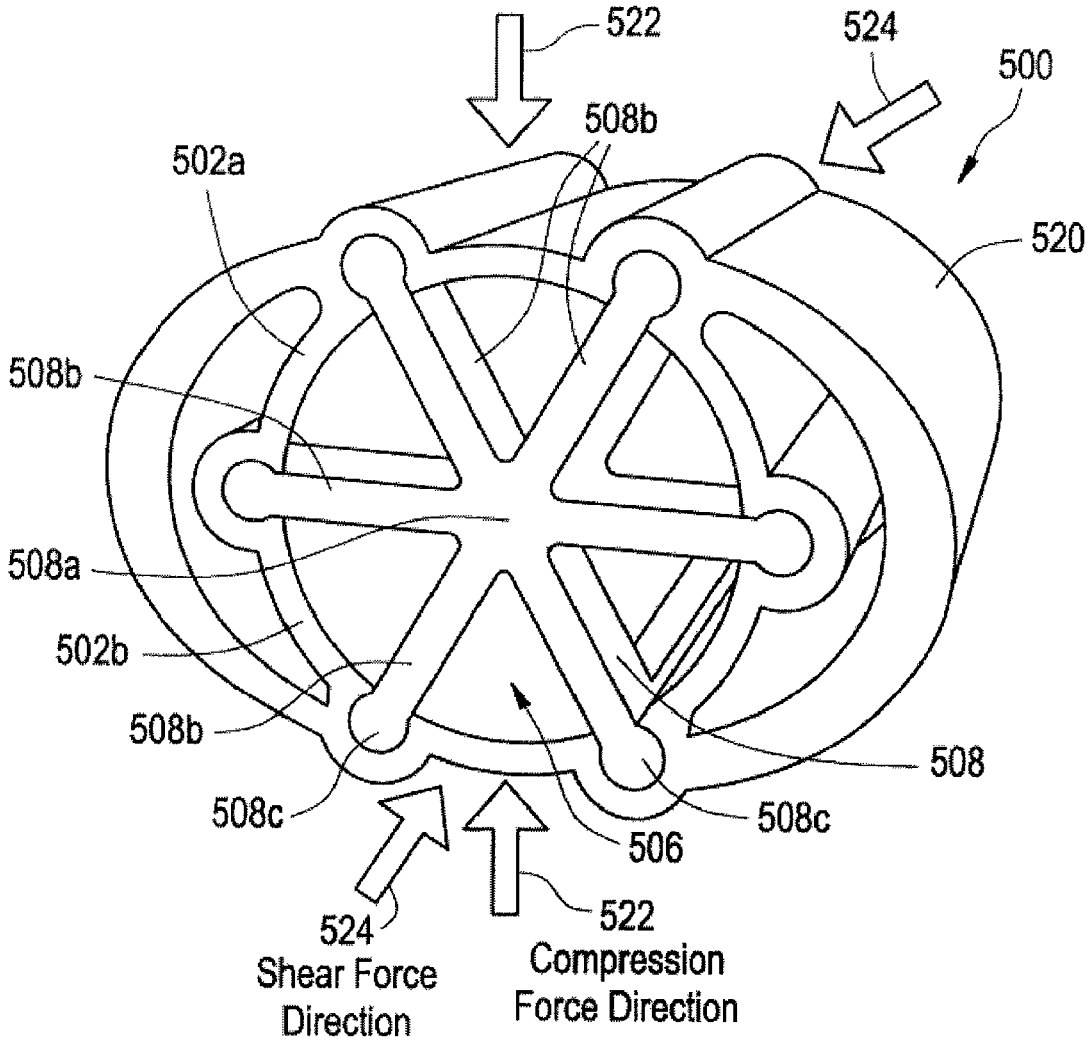
FIG. 6 illustrates another example impact-attenuation member structure in accordance with this invention.

FIG. 6 illustrates another example impact-attenuating member structure 500 in accordance with this invention. In this illustrated example structure 500, while not a requirement, the body member portions 502*a* and 502*b* are integrally formed with one another as a unitary, one piece construction, and these body portions 502*a* and 502*b* form an open space 506 therebetween. Additionally, in this illustrated example structure 500, again while not a requirement, the body portions 502*a* and 502*b* are integrally formed with a base member 520, which may be attached to or integrally formed as part of another overall structure, such as an article of footwear or other foot-receiving device product structure. The body portions 502*a* and 502*b*, as well as the base member 520, may be made from any desired materials having any desired characteristics without departing from this invention, including, for example, the various materials and characteristics described above for use as body members 102, 104, 404*a*, and 404*b*.

In the example structure 500 of FIG. 6, the spring member 508 includes a central hub region 508*a* with multiple arms 508*b* extending from the hub region 508*a* toward and to the body portions 502*a* and 502*b*. While the arms 508*b* may engage the body portion(s) in any desired manner without departing from this invention, in this illustrated example structure 500, the free ends of the arms 508*b* included enlarged or bulbed portions 508*c* that engage chambers 510 defined by or provided in or on the body portion(s) 502*a* and/or 502*b*. The spring member 508, including the central hub region 508*a*, the arms 508*b*, and the enlarged portions 508*c*, may be made as a unitary, one piece construction or from any desired number of individual parts or pieces without departing from this invention. The overall spring member 508 also may be made from any desired material(s) having any desired characteristics, without departing from this invention, including, for examples, the various materials and characteristics described above for use in connection with spring members 108 and 408.

In the illustrated example structure 500, six arm members 508*b* extend from the central hub region 508*a* at an evenly spaced distribution around the hub region 508*a*. Of course, any number of arms 508*b*, in any desired arrangement with respect to the hub region 508*a*, may be provided without departing from this invention.

Also, in this illustrated example structure 500, the spring member 508 has an axial length such that one set of arm members extends from the central hub region 508*a* at one side of the structure 500 and a second set of arm members 508*b* extends from the central hub region 508 axially spaced and at the opposite side of the structure 500. While the body portions 502*a* and 502*b* extend the entire axial length of the spring member 500 in this illustrated structure, if desired, separate body portions also may be provided for each separate, axially spaced set of arm members 508*b*. Also, the various axially spaced sets of arm members 508*b* and/or body portions 502*a* and 502*b* may be constructed the same or different without departing from the invention, e.g., they may have the same or different overall structures, configurations, numbers, orientations, materials, and the like without departing from this invention.

As noted above, the body members 502*a* and 502*b* may be contained within, attached to, and/or integrally formed with a base member 520. The base member 520 with the body portions 502*a* and 502*b* and the spring member 508 may form a separate impact-attenuation member structure 500 (as shown in FIG. 6). Alternatively, if desired, the base member 520 (optionally along with at least the body portions 502*a* and 502*b*) may form a portion of another device's structure, such as a heel cage or heel unit structure, a sole member or other foot-supporting member structure, an overall footwear or other foot-receiving device structure, etc.

In use, if desired, the spring member 508 may be releasably and removably mounted with respect to the body portions 502*a* and 502*b* (e.g., by sliding the spring member 508 outward). This feature may allow interchange of one spring member 508 for another, e.g., to provide different impact-attenuation characteristics for different uses or users, to replace a broken spring member 508, etc. Alternatively or additionally, if desired, the body portions 502*a* and 502*b* (optionally with the spring member attached thereto) may be releasably and removably mounted with respect to any present base member (e.g., base member 520) or other device or structure to which it is attached (such as an article of footwear or other foot-receiving device, etc,). As still another option or alternative, if desired, the overall structure 500 may be releasably and removably mounted with respect to another article to which it is mounted (with or without a base member 520), such as an article of footwear or other foot-receiving device, etc. A wide variety of options are possible to allow replacement, interchange, and/or customization of the impact-attenuation properties, e.g., of an article of footwear or other foot-receiving device by replacing, exchanging, and/or reorienting the spring member 508, body portions 502*a* and 502*b*, and/or overall impact-attenuation member 500.

Again, the overall impact-attenuation member structure 500 according to this example provides excellent impact-attenuation properties against substantially vertical, jump, or step landing forces 522 while also providing stability with respect to lateral or shear forces 524. This may be accomplished, using the structure 500, by mounting the structure 500 such that the axial length of the spring member 508 extends substantially in the expected direction of the lateral forces 524 (e.g., extending in the medial-to-lateral side direction of the article of footwear or other foot-receiving device product), which in turn mounts the body portions 502*a* and 502*b* such that their major surfaces extend substantially parallel to the expected direction of the lateral forces 524.

As noted above, the various impact-attenuation members and/or the parts thereof may be made from any suitable or desired materials without departing from the invention, including the various examples of materials noted above. Also, the various parts of the impact-attenuation members of the above examples may be made in any desired manner without departing from the invention, including in conventional manners known in the art. For example, if desired, the various body portions or members, spring members, base members, etc., and/or combinations thereof may be made from plastic materials using conventional techniques, including injection molding techniques and/or other molding techniques, without departing from the invention.

Figure 7:
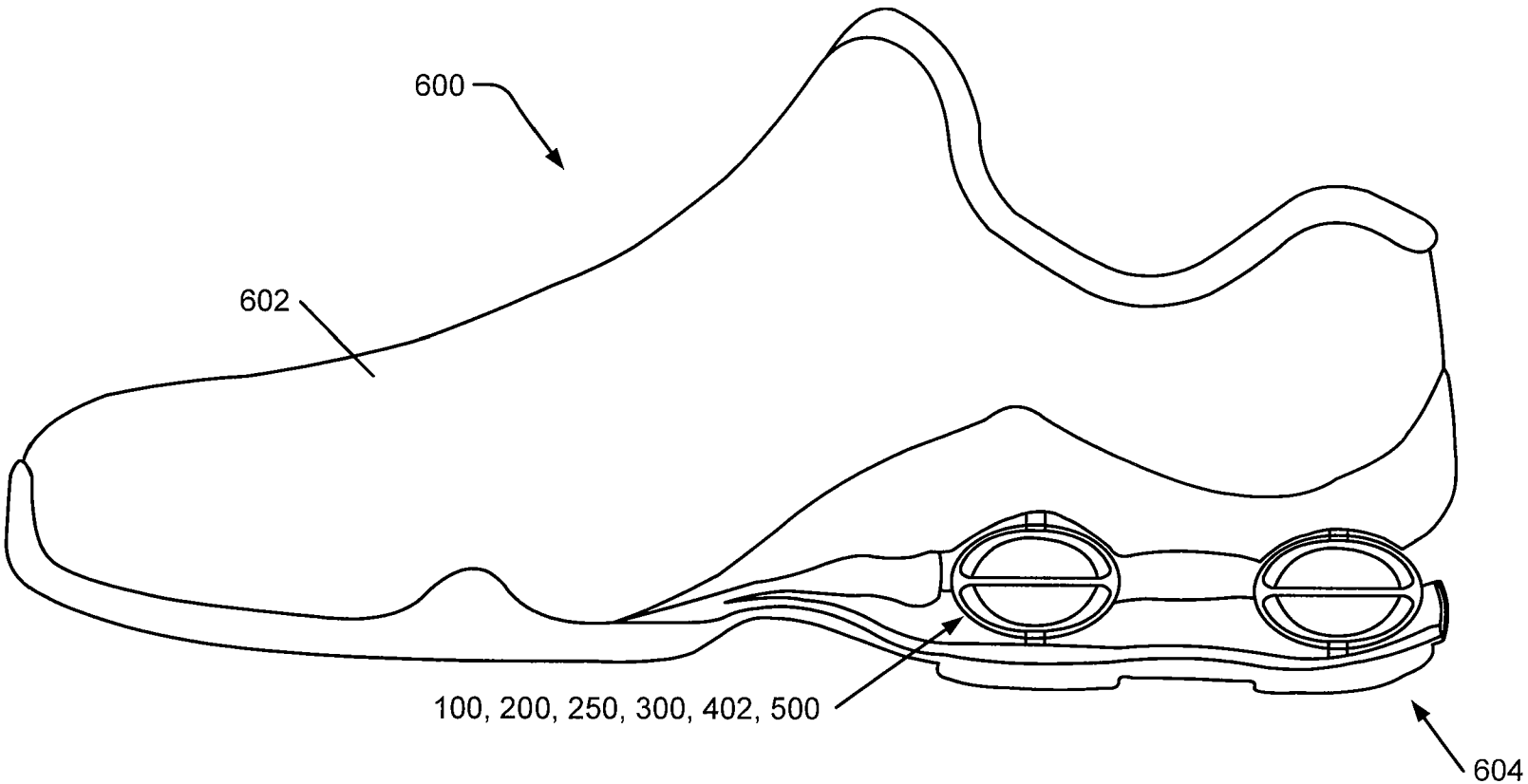
FIG. 7 illustrates an example article of footwear structure including plural impact-attenuation members in accordance with an example of this invention.

As described above, impact-attenuation members of the various types described above may be incorporated into footwear structures and other foot-receiving device products. FIG. 7 illustrates an example footwear product 600 in which impact-attenuation members in accordance with examples of this invention (e.g., members 100, 200, 250, 300, 402, and/or 500) are mounted. The article of footwear includes an upper member 602 and a sole structure 604 engaged with the upper member 602 in any desired manner, including in conventional manners known and used in the art, such as by adhesives or cements; fusing techniques; mechanical connectors; stitching or sewing; and the like. Also, the upper member 602 and sole structure 604 may be made of any desired materials in any desired constructions, including with conventional materials and conventional constructions as are known and used in the art, including, for example, the materials and constructions used for conventional footwear products available from NIKE, Inc. of Beaverton, Oreg. under the "SHOX" brand trademark. While the example structure 600 of FIG. 7 illustrates the impact-attenuation members 100, 200, 250, 300, 402, 500 in the heel area of an article of athletic footwear, those skilled in the art will appreciate that such members may be included at any desired location(s) in any type of footwear 600 or foot-receiving device structure, including, for example, in the forefoot portion. Again, any number, arrangement, and/or style of impact-attenuation members may be included in a footwear structure 600 without departing from this invention.

Also, while the illustrated footwear structure 600 shows the impact-attenuation members 100, 200, 250, 300, 402, 500 open and exposed, those skilled in the art will recognize, of course, that the impact-attenuation members 100, 200, 250, 300, 402, 500 may be covered (e.g., embedded within a midsole or other portion of the sole or foot-supporting structure, enclosed by a restraining member structure, etc.) without departing from this invention.

E. CONCLUSION

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A device comprising:

a first body portion;

a second body portion, wherein the first body portion and the second body portion, at least in part, define a base orientation of the device and wherein an open space is defined between the first body portion and the second body portion; and a first spring member extending across the open space and engaging the first body portion and the second body portion, wherein when a force is applied to at least one of the first body portion or the second body portion so as to change the device out of the base orientation, the first spring member exerts a force that urges the device toward the base orientation, wherein the first spring member includes a polymeric element that stretches under a tensile force when the force is applied to at least one of the first body portion or the second body portion, wherein the first body portion is at least substantially contained within the first spring member and wherein the second body portion is at least substantially contained within the first spring member.

2. A device according to claim 1, wherein the first body portion includes a first rounded edge and a second rounded edge, wherein the first and second rounded edges of the first body portion provide movable engagement with the first spring member, and wherein the second body portion includes a first rounded edge and a second rounded edge, wherein the first and second rounded edges of the second body portion provide movable engagement with the first spring member.

3. A device according to claim 1, wherein the first body portion is an independent part from the second body portion.

4. A device according to claim 1, wherein the first body portion and the second body portion are formed as a unitary one-piece construction.

5. A device according to claim 1, wherein at least one of the first body portion and the second body portion define a first spring engagement portion on a first side of the open space, and at least one of the first body portion and the second body portion define a second spring engagement portion on a second side of the open space.

6. A device comprising:

a first arched body portion;

a second arched body portion facing the first arched body portion, wherein the first arched body portion and the second arched body portion, at least in part, define a base orientation of the device and wherein an open space is defined between the first arched body portion and the second arched body portion; and a first spring member at least partially included in the open space and extending to at least substantially contain the first arched body portion and the second arched body portion, wherein when a force is applied to at least one of the first arched body portion or the second arched body portion so as to change the device out of the base orientation, the first spring member exerts a force that urges the device toward the base orientation, wherein the first spring member includes a polymeric element that stretches under a tensile force when the force is applied to at least one of the first arched body portion or the second arched body portion.

7. A device according to claim 6, further comprising:

a third arched body portion; and a fourth arched body portion facing the third arched body portion, wherein a second open space is defined between the third arched body portion and the fourth arched body portion, wherein the first spring member is at least partially included in the second open space and extends to at least substantially contain the third arched body portion and the fourth arched body portion.

8. A device according to claim 6, wherein the first arched body portion includes a first rounded edge and a second rounded edge, wherein the first and second rounded edges of the first arched body portion provide movable engagement with the first spring member, and wherein the second arched body portion includes a first rounded edge and a second rounded edge, wherein the first and second rounded edges of the second arched body portion provide movable engagement with the first spring member.

9. A device comprising:

a first arched body portion;

a second arched body portion facing the first arched body portion, wherein an open space is defined between the first arched body portion and the second arched body portion; and a first spring member at least partially included in the open space and extending to at least substantially contain the first arched body portion and the second arched body portion, wherein a portion of the first arched body portion extends through the first spring member.

10. A device according to claim 9, further comprising:

a first base engaged with the portion of the first arched body portion extending through the first spring member.

11. An article of footwear, comprising:

an upper member;

a sole member engaged with the upper member; and an impact attenuating device engaged with at least one of the upper member or the sole member, wherein the impact attenuating device includes:

(a) a first body portion;

(b) a second body portion, wherein the first body portion and the second body portion, at least in part, define a base orientation of the impact attenuating device and wherein an open space is defined between the first body portion and the second body portion; and (c) a first spring member extending across the open space and engaging the first body portion and the second body portion, wherein when a force is applied to at least one of the first body portion or the second body portion so as to change the device out of the base orientation, the first spring member exerts a force that urges the device toward the base orientation, wherein the first spring member includes a polymeric element that stretches under a tensile force when the force is applied to at least one of the first body portion or the second body portion, wherein the first body portion is at least substantially contained within the first spring member and wherein the second body portion is at least substantially contained within the first spring member.

12. An article of footwear according to claim 11, wherein the impact attenuating device is located in a heel area of the article of footwear.

13. An article of footwear according to claim 11, wherein the impact attenuating device is at least partially visible from an exterior of the article of footwear.

14. An article of footwear according to claim 13, further comprising:

a second impact attenuating device engaged with at least one of the upper member or the sole member.

15. An article of footwear according to claim 11, wherein the article of footwear is a piece of athletic footwear.

16. An article of footwear according to claim 11, wherein the first body portion includes a first rounded edge and a second rounded edge, wherein the first and second rounded edges of the first body portion provide movable engagement with the first spring member, and wherein the second body portion includes a first rounded edge and a second rounded edge, wherein the first and second rounded edges of the second body portion provide movable engagement with the first spring member.

17. An article of footwear according to claim 11, wherein at least one of the first body portion and the second body portion define a first spring engagement portion on a first side of the open space, and at least one of the first body portion and the second body portion define a second spring engagement portion on a second side of the open space.

18. An article of footwear according to claim 11, further comprising:

a base member engaging at least one of the first spring member, the first body portion, and the second body portion.

19. An article of footwear according to claim 11, wherein an outer portion of the first spring member is engaged with the base member.

20. An article of footwear according to claim 11, wherein an outer portion of at least one of the first body portion or the second body portion is engaged with the base member.

21. An article of footwear according to claim 11, wherein an outer portion of the first spring member is releasably engaged with the base member.

22. An article of footwear, comprising:

an upper member;

a sole member engaged with the upper member; and an impact attenuating device engaged with at least one of the upper member or the sole member, wherein the impact attenuating device includes:

(a) a first body portion;

(b) a second body portion, wherein the first body portion and the second body portion, at least in part, define a base orientation of the impact attenuating device and wherein an open space is defined between the first body portion and the second body portion; and (c) a first spring member extending across the open space and engaging the first body portion and the second body portion, wherein an outer portion of at least one of the first body portion or the second body portion is releasably engaged with the base member.

23. An article of footwear, comprising:

an upper member;

a sole member engaged with the upper member; and an impact attenuating device engaged with at least one of the upper member or the sole member, wherein the impact attenuating device includes:

(a) a first body portion;

(b) a second body portion, wherein the first body portion and the second body portion, at least in part, define a base orientation of the impact attenuating device and wherein an open space is defined between the first body portion and the second body portion; and (c) a first spring member extending across the open space and engaging the first body portion and the second body portion, wherein the first spring member is engagable with respect to the base member in plural different orientations.

24. An article of footwear, comprising:

an upper member;

a sole member engaged with the upper member; and an impact attenuating device engaged with at least one of the upper member or the sole member, the impact attenuating device including:

(a) a first arched body portion;

(b) a second arched body portion facing the first arched body portion, wherein the first arched body portion and the second arched body portion, at least in part, define a base orientation of the device and wherein an open space is defined between the first arched body portion and the second arched body portion; and (c) a first spring member at least partially included in the open space and extending to at least substantially contain the first arched body portion and the second arched body portion, wherein when a force is applied to at least one of the first arched body portion or the second arched body portion so as to change the device out of the base orientation, the first spring member exerts a force that urges the device toward the base orientation, wherein the first spring member includes a polymeric element that stretches under a tensile force when the force is applied to at least one of the first arched body portion or the second arched body portion.

25. An article of footwear according to claim 24, wherein the impact attenuating device further includes:

(d) a third arched body portion; and (e) a fourth arched body portion facing the third arched body portion, wherein a second open space is defined between the third arched body portion and the fourth arched body portion, wherein the first spring member is at least partially included in the second open space and extends to at least substantially contain the third arched body portion and the fourth arched body portion.

26. An article of footwear according to claim 24, wherein the impact attenuating device is located in a heel area of the article of footwear.

27. An article of footwear according to claim 24, wherein the impact attenuating device is at least partially visible from an exterior of the article of footwear.

28. An article of footwear according to claim 24, further comprising:

a second impact attenuating device engaged with at least one of the upper member or the sole member.

29. An article of footwear according to claim 24, wherein the article of footwear is a piece of athletic footwear.

30. An article of footwear according to claim 24, wherein a portion of the first arched body portion extends through the first spring member.

31. An article of footwear according to claim 24, further comprising:

a base member engaging at least one of the first spring member, the arched first body portion, and the second arched body portion.

32. An article of footwear according to claim 31, wherein an outer portion of the first spring member is engaged with the base member.

33. An article of footwear according to claim 31, wherein an outer portion of at least one of the first arched body portion or the second arched body portion is engaged with the base member.

34. An article of footwear according to claim 31, wherein an outer portion of the first spring member is releasably engaged with the base member.

35. An article of footwear according to claim 31, wherein an outer portion of at least one of the first arched body portion or the second arched body portion is releasably engaged with the base member.

36. An article of footwear according to claim 31, wherein the first spring member is engagable with respect to the base member in plural different orientations.

37. An article of footwear according to claim 31, wherein the first arched body portion includes a first rounded edge and a second rounded edge, wherein the first and second rounded edges of the first arched body portion provide movable engagement with the first spring member, and wherein the second arched body portion includes a first rounded edge and a second rounded edge, wherein the first and second rounded edges of the second arched body portion provide movable engagement with the first spring member.

* * * * *